United States Patent [19]

Makarenko

[11] Patent Number: 4,842,294

[45] Date of Patent: Jun. 27, 1989

[54] SKI BINDING

[75] Inventor: Vladimir S. Makarenko, Leningrad, U.S.S.R.

[73] Assignee: Leningradsky Politekhnichesky Institut, Leningrad, U.S.S.R.

[21] Appl. No.: 14,057

[22] PCT Filed: Apr. 18, 1986

[86] PCT No.: PCT/SU86/00033

§ 371 Date: Dec. 3, 1986

§ 102(e) Date: Dec. 3, 1986

[87] PCT Pub. No.: WO86/06290

PCT Pub. Date: Nov. 6, 1986

[30] Foreign Application Priority Data

Apr. 26, 1985 [SU] U.S.S.R. ..... 3879999

[51] Int. Cl.[4] ..... A63C 9/10

[52] U.S. Cl. ..... 280/615

[58] Field of Search ..... 280/611, 614, 615, 633, 280/634

[56] References Cited

U.S. PATENT DOCUMENTS 4,353,576 10/1982 Salomon ..... 280/615
4,487,427 12/1984 Salomon ..... 280/615

FOREIGN PATENT DOCUMENTS 3115618 3/1982 Fed. Rep. of Germany ..... 280/615
3240750 5/1984 Fed. Rep. of Germany .
2466259 10/1970 France .

*Primary Examiner*—Charles A. Marmor
*Assistant Examiner*—Richard Camby
*Attorney, Agent, or Firm*—Burgess, Ryan & Wayne

[57] ABSTRACT

A ski binding comprises rest pins (1) mounted on a ski (2) for fitting in corresponding holes (3) in a toe portion of a sole (4) of boot (5).

The outer surface of at least one rest pin (I) in conjunction with the surface of the corresponding hole (3) form a friction couple.

4 Claims, 4 Drawing Sheets

SKI BINDING

FIELD OF THE INVENTION

The invention relates to sporting gear, and more specifically, to ski binding for cross-country skis.

PRIOR ART

Today we witness a transition from a widely employed "Racing Norm 38" type boot to a "Racing Norm 50" type boot. When the skier uses classical stride on a well-prepared track the first of the two above-mentioned types is preferable because a narrower boot sole toe portion provides for more effective pushing of the skier. a considerably smaller effort is needed to overcome the resistance of the sole to bending towards the tip of the ski due to a narrower boot sole toe portion. The use of skating stride makes much higher demands of the sole twisting resistance. Under these conditions a prior art ski binding of the "Rotafella" type provides for higher rigidity, i.e. a better control of the ski. But this type of bindings does not also meet all the necessary requirements, e.g. from the standpoint of skating stride, as the sole twisting occurs.

It is known that the cross-section area of the ski boot plastic sole grows in the direction from the sole toe to its heel. The cross-section area of the boot is the largest in the skier's foot area.

On one hand, when the boot is locked to the ski in the skier's foot area the sole resistance to twisting steeply increases which is of special importance when skating stride is used as the breaking moments acting on the binding grow weaker. But locking the boot in said area is complicated by the relative complexity of designing a lock that would ensure the locking of the boot in said area while at the same time meeting all the specified operating requirements.

On the other hand, when the boot is locked in the foot area the sole resistance to bending in the vertical plane towards the ski toe is increased causing a reduction in the skier's pushing efficiency when classical stride is used.

Bearing this in mind it can be inferred that depending on the stride used (classical or skating) and the track condition (snow, ice-crust) it is expedient to choose the optimum boot sole resistance-to-twisting ratio which, in its turn, determines the boot sole resistance to bending in the abovementioned vertical plane. The latter result may be attained by shifting the sole locking area along the boot axis. But shifting the sole locking area along the axis of one and the same boot is a very complicated task as such a solution does not agree with prior art binding designs.

There is a prior art ski binding which consists of rest pins, of two parts each, and a lock that restrains the boot vertical movement (cf. FRG Patent Application as published for opposition No. 3240750, IPC A 630). One part of each pin is directly fixed in the ski (boot) body, the other part fits in the corresponding boot sole (ski) hole. If the bottom part of the pin is fixed in the ski body, then, in order to lock the boot it is necessary to place it so that upper parts of the pins fit in the corresponding holes in the boot sole toe. To restrain the boot vertical movement various locks are employed. Advantages of said binding include relatively high adaptability to manufacture and simple design, its quick mounting and dismantling, use of different types of locks. Disadvantages include relatively poor functional qualities of the binding when locking and unlocking the boot because this can be done only manually.

A prior art binding (cf. FRG Pat. No. G 8425984.1, IPC A 63C) comprises ski-mounted rest pins for mating with corresponding holes in the boot sole toe and a lock featured as a bracket-shaped blade spring for straddling from above the boot sole toe and having one end attached to the ski. Relatively high adaptability to manufacture, low production cost, small overall dimensions, light weight, automatic (no need to use hands) locking of the boot to the ski may be cited among its advantages. But the binding may be used only with a ski boot that has a projecting sole toe or a welt. When the skier pushes a horizontal component force perpendicular to the ski longitudinal axis occurs and a substantial torque is developed, as the skier's push zone does not coincide with the boot lock zone. Thus the boot sole twisting occurs. Said disadvantage is characteristic of all types of binding designed for use with ski boots with projecting toe.

SUMMARY OF THE INVENTION

The invention is directed to the provision of a ski binding that would make it possible to more evenly distribute the forces acting on the rest pin and the boot sole.

The problem is solved by designing a ski binding comprising rest pins and corresponding holes disposed on a ski or on a boot wherein, according to the invention, the outer surface of at least one rest pin in conjunction with the surface of the corresponding hole forms a friction couple.

The proposed ski binding provides for a more reliable operation as the friction couple ensures the boot locking onto the rest pins due to their being snug against the corresponding pins surface.

Locking the boot to the ski by means of the friction couple makes impossible the rest pin movement against the corresponding hole when the skier pushes which, in its turn, substantially reduces the ski binding wearability. The wear caused by the movement of these surfaces will occur only when the boot is being locked onto the pin or unlocked. A possibility of backlash and, consequently, of impact loads is considerably reduced. All this amounts to higher reliability of the binding. The proposed ski binding may be used both with boots having a sole toe projecting beyond the boot or a welt and without it.

It is very practicable that several pairs of corresponding holes disposed along the longitudinal axis of the boot or the ski correspond to one pair of pins on the ski or on the boot. Such a design makes it possible to use one pair of boots both for skating stride and regular classical stride. Skating stride is known to make higher demands of the boot sole in view of its twisting. To reduce the twisting it is recommended to shift the boot locking zone to the skier's toe zone, i.e. to bring the boot locking zone into coincidence with the skier's pushing zone. But in this zone the sole is wider than in the toe portion of the boot. On one hand, this will prove beneficial for skating stride as it reduces the sole twisting. But, on the other hand, there are also negative consequences caused by the growing resistance of the sole to bending in the vertical plane parallel to the ski longitudinal axis which results in lower skier's pushing efficiency. The requirements are thus contradictory. That is why it is strongly advisable to lock the boot onto the rest pins fitting them in the corresponding holes disposed in the push zone when skating stride is used, while in case of classical stride the holes disposed the narrower forward (toe) portion of the sole should be used. It is of special importance when competing because at present approximately one half of the track is specially prepared for classical stride while the other half is prepared for skating stride. In such a case it is recommended to employ the proposed binding design providing for quick change of the boot locking zone depending on the attendant conditions with a view to uniformly control the forces acting on the binding and the boot. It should be noted that the expediency of the boot lock zone shifting is determined not only by the skier's stride mode but also by the weather conditions. Ice-crust, firn, wet snow bring about increased sole twisting. Under such conditions it is also advisable to transfer the boot locking zone farther from the sole toe in order to shift the boot towards the ski toe attaining in this way a better control of the ski. A similar situation occurs, e.g. when the terrain is rugged or when the ski-track is ill-prepared.

It is expedient that each friction couple be formed by at least a part of the outer surface of the rest pin and a part of the surface of the corresponding hole, in contact with it. Varying both the length and the shape of said parts makes it possible to change the value of frictional forces determining the boot locking reliability. For example, the length of the parts being increased the forces increase too other things being equal. A similar situation occurs when their shape is changed e.g. from cylindrical to conic. A similar picture is observed also when there is an increase in the pin parts diameter, the diameter of the corresponding parts of the hole remaining the same.

In the preferred embodiment of the invention the friction couple represents a Morse taper which ensures high security of the boot locking to the ski.

According to one embodiment of the invention at least one corresponding hole contains a shell of elastic material, the friction couple being formed by the outer surface of the corresponding rest pin and the surface of the shell in contact with it. It is possible to fix the shell not in the hole but to the rest pins made e.g. of metal. Introduction of said shell made of elastic material into the contact zone between the surface parts of the rest pin and the corresponding hole provides for more even load distribution with respect to the rest pin as the elastic material of the shell would tend to shift from a heavy pressure to underpressure zone equalizing, as a result, pressure per unit of the pin surface area. Besides, by making the shells removable it becomes possible to change frictional forces between the shell and the corresponding part of the pin or the hole surface, depending on the weather or other attendant conditions the skier may use different shells.

It is expedient that the outer surface of the pin have cuts. Making cuts on the pin provides for additional increase in the cohesive force between the contacting surface parts of the pin and the corresponding hole or the pin and the shell. In one embodiment of the invention the outer surface of the pin is furnished with annular grooves more secure locking of the boot to the ski.

According to another embodiment of the invention the shell may be provided with means for controlling the degree of its pressing against the rest pin. This permits placing the boot on the rest pins with the least degree of pressing the shell against the rest pin, i.e. with the least effort possible. Having placed the boot on the rest pins it is advisable to increase the degree of pressing the shell against the rest pin providing for more secure locking of the boot to preclude its movement in the vertical plane, i.e. reducing the probability of accidental unlocking.

BRIEF DESCRIPTION OF THE DRAWINGS

Other objects and advantages of the present invention will become clear from the following description of specific embodiments thereof with reference to the accompanying drawings, wherein.

BEST MODE OF CARRYING OUT THE INVENTION

Figure 1:
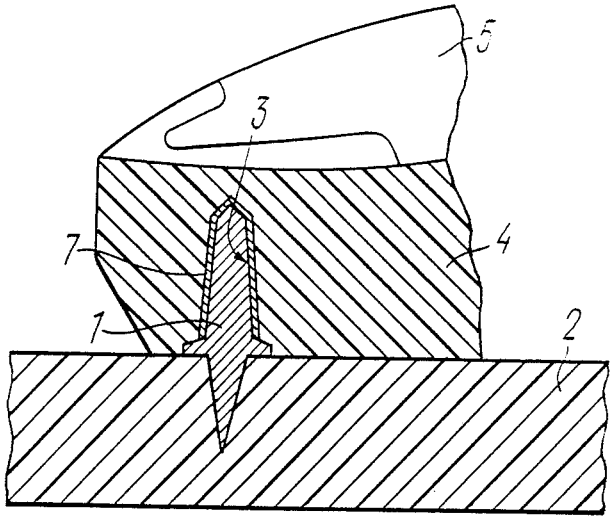
FIG. 1 represents the locking of the boot in the ski binding, according to the invention (longitudinal section)

A ski binding comprises rest pins 1 (FIG. 1–7) disposed on a ski 2 and corresponding holes 3 in a sole 4 of a boot 5. At least a part of the outer surface of each point 1 and a part of the surface of the corresponding hole 3 in contact with it form a friction couple. The friction couple may be formed by a Morse taper or a self-holding taper (FIG. 1). Several pairs of holes 3 disposed along the longitudinal axis of the ski 2 and the boot 5 may correspond to one pair of pins 1 (FIG. 5).

The ski binding operates as follows.

The skier obtains such a position of the sole 4 of the boot 5 in which the axes of the rest pins 1 and the corresponding holes 3 coincide. Then, exerting force he moves the sole 4 of the boot 5 along the rest pins 1 until its base surface rests upon the surface of the ski 2. After that force is applied to ensure tight fitting of the pins 1 in the holes 3 for locking the boot 5.

Virtually complete elimination of backlash resulting in insignificant joint wear, good control of the ski 2 may be cited along with simplicity of design, adaptability to manufacture and light weight (no lock) among the advantages of said embodiment.

To improve operating characteristics the ski binding may be supplemented with a shell 6 (FIG. 2) set in each hole 3 and made of elastic material, e.g. rubber. In this case the friction couple is formed by the outer surface of the corresponding pin 1 and the surface of the shell 6 in contact with it.

Figure 2:
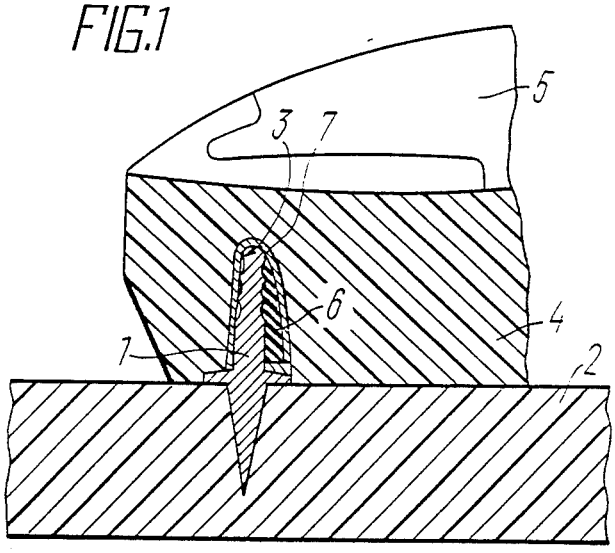
FIG. 2 is the same, using a shell.

The ski binding, shown in FIG. 2, operates as follows. To lock the boot 5 the skier has to press with his foot the sole 4 of the boot 5 vertically downwards along the axis of the pin 1. The pin 1 enters the hole 3 spreading the shell 6 (pressing it to the wall of the hole 3). Having entered the hole 3 the rest pin 1 is retained in the sole 4 of the boot 5 due to the frictional force that is increased at the moment of pushing (sole bending) in this way ensuring the secure locking of the boot 5.

According to said embodiment of the ski binding the locking of the boot 5 is effected due to the elastic forces pressing together the surfaces of the shell 6 and the rest pin 1.

Each hole 3 may contain a reinforcing sleeve 7 (FIGS. 1–7), e.g. of metal.

To control the pressing of the surface of the shell 6 to the rest pin 1 the binding may be provided with adequate means.

Said means of controlling the degree of the pressing of the shell 6 against the rest pin 1 may be represented e.g. by a threaded connection comprising a hollow screw 8 (FIG. 3) placed in the threaded portion 9 of the reinforcing sleeve 7 set in the projecting toe of the sole 4 of the boot 5. The shell 6 is fitted into the screw 8. When the screw 8 is screwed into the sleeve 7 the shell 6 gets distorted thus increasing the frictional force between the pin 1, introduced into the hole 3 of the sleeve 7, and the shell 6. Accordingly, when the screw 8 is screwed out of the sleeve 7 said frictional force decreases.

Figure 3:
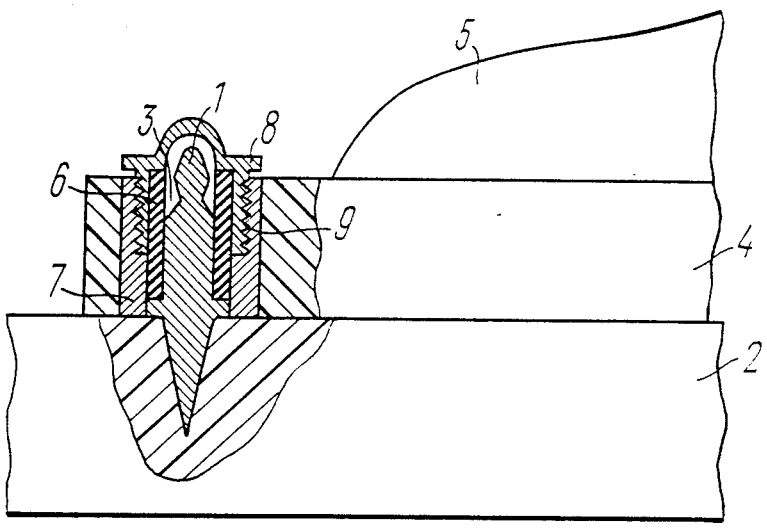
FIG. 3 shows the locking of the boot with a projecting sole toe in the ski binding, according to the invention (longitudinal section)

The ski binding, shown in FIG. 3 operates as follows.

Before locking the boot 5 it is advisable to unload the shell 6, thus creating the most favourable conditions for fitting the pin 1 in the hole 3 of the sole 4. After that the load acting on the shell 6 is increased by screwing the screw 8 into the sleeve 7. The increase of the load brings about the increase in the cohesive force of the elastic material of the shell 6 and, consequently, of the boot 5 with the pin 1 and with the ski 2. Thus it becomes possible to improve the working conditions of the pin 1, to improve its reliability and durability. Upon deterioration the sleeve 6 may be quickly replaced.

Figure 4:
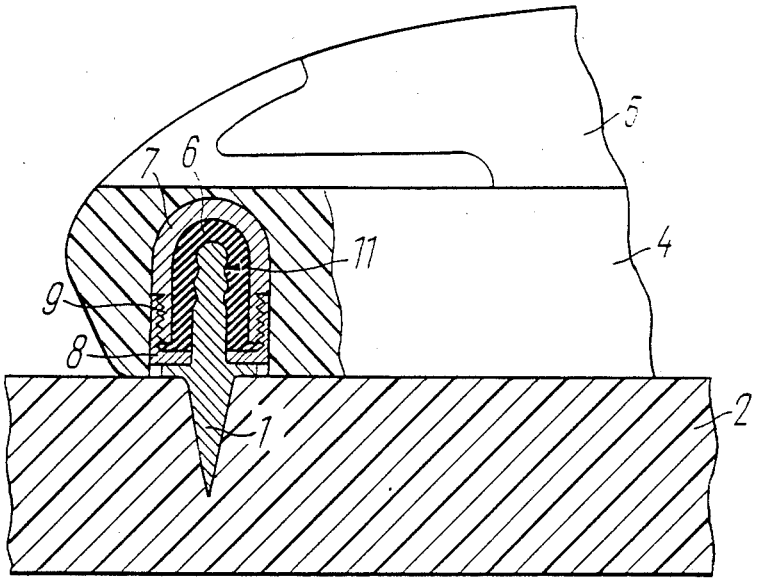
FIG. 4 is the same, but with the boot that does not have a projecting sole toe (longitudinal section)
Figure 5:
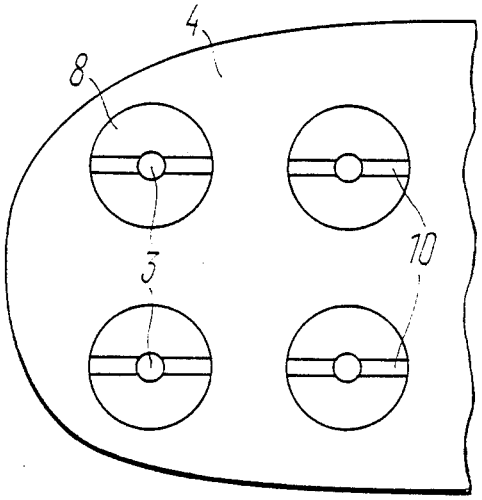
FIG. 5 shows the boot sole (bottom view)

FIGS. 4, 5 show an embodiment of the proposed binding to be used with the boot 5 that does not have a projecting toe of the sole 4 or a welt.

According to this embodiment of the invention the reinforcing sleeve 7 is set in the sole 4 in the skier's toe zone, and the threaded portion 9 for the screw 8 is disposed in the lower part of the sleeve 7. For screwing the screw 8 it has got a screwdriver slot 10.

Before locking the boot 5 the required degree of pressing the shell 6 is obtained by rotating the screw 8, and then the pin 1 is fitted in the hole 3 of the sole 4 of the boot 5. The force restraining the boot 5 from moving in the vertical plane on the ski 2 is defined by the pressure exerted on the shell 6. To increase the cohesive force between the pin 1 and the shell 6 the outer surface of the pin 1 may have cuts or annular grooves 11.

Figure 6:
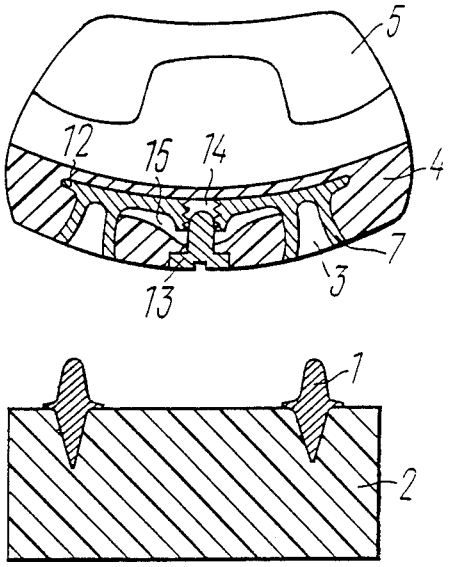
FIGS. 6, 7 are the embodiments of the ski binding (longitudinal section) in the position before fitting the pins on the ski in the corresponding holes in the boot.

FIG. 6 shows an embodiment of the ski binding, wherein a pair of rest pins 1 is mounted on the ski 2 and a pair of reinforcing sleeves 7 made solid with a plate 12 is set in the sole 4 of the boot 5. Between the sleeves 7 there is an aperture in the sole 4 for introducing into it an adjusting screw 13 and screwing said screw in a threaded hole 14 in the plate 12. The plate 12 is placed in a cavity 15 of the sole 4 so as to be able to bend within said cavity 15 when the screw 13 rotates, thus changing the angle between the axes of the holes 3 in the reinforcing sleeves 7.

In the initial position, i.e. before introducing the pins 1 in the holes 3, the axes of the pins 1 are not aligned with the axes of the corresponding holes 3.

The ski binding, shown in FIG. 6 operates as follows.

Before the start of operation a required angle between the axes of the holes 3 ensuring the predetermined frictional force between the contacting surfaces of the pins 1 and the holes 3 is set by retating the screw 13.

After that the upper ends of the pins 1 are brought into coincidence with the holes 3 and pressure is exerted on the sole 4 of the boot 5 for fitting the pins 1 in the holes 3 of the sleeves 7. This will cause bending of the plate 12 and give rise to elastic stresses within said plate, forcing the sleeves 7 into their initial position. This, in its turn, will result in increasing the frictional forces between the contacting surfaces of the sleeves 7 and the pins 1 making for the locking of the boot 5 to the ski 2.

Figure 7:
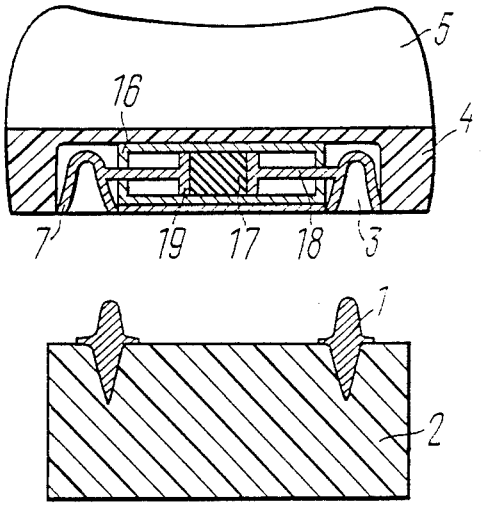

FIG. 7 shows one more embodiment of the proposed ski binding.

One or several pairs of pins 1 are mounted on the ski 2.

One or several pairs of reinforcing sleeves 7 are set in the sole 4 of the boot 5. Between the sleeves there is a cylinder 16 that has an elastic shell 17 placed in its cavity. Each sleeve 7 has a rod 18 the free end thereof introduced into the cylinder 16 and resting against the shell 17 through a flange 19.

In the initial position the distance between the axes of the holes 3 is somewhat more than that between the axes of the pins 1, but when mating the pins 1 with the holes 3 the upper end of each pin 1 should be aligned with the corresponding hole 3.

The pins 1 being introduced into the holes 3 of the sleeves 7 the latter move towards each other while the rods 18 also advance compressing the shell 17. Forces arising in the shell 17 result in increasing the frictional force between the contacting surfaces of the pins 1 and the sleeves 7.

To unlock the boot 5 from the ski 2 (FIGS. 1–7) it is necessary to secure the ski 2 and to apply force to the boot 5 directed upwards along the longitudinal axis of the pins 1.

The pins 1 and the corresponding holes 3 may be disposed accordingly either on the ski 2 or on the sole 4 and vice versa. Trial operation of the proposed ski binding demonstrated that such connections function very reliably. The cohesive force between the outer surface of the pin 1 and the surface of the reinforcing sleeve 7 set in the hole 3 is determined by the angle of taper and the material of the upper portion of the pin 1 and the sleeve 7 as well as by the contacting surfaces structure (surface finish, specific nurling, degree of roughness, etc.).

INDUSTRIAL APPLICABILITY

The invention may be used to the best advantage both for sporting cross-country skis and for tourist cross-country skis on a hard ski-track and also when the skier uses skating stride.

I claim:

1. A ski binding comprising:
rest pins disposed on one of a ski and a boot;
holes corresponding to said rest pins disposed on the other of said ski and boot;
an outer surface of at least one rest pin forming a friction couple with an inner surface of at least one corresponding hole; and
the friction couple represents a Morse taper.

2. A ski binding comprising:
rest pins disposed on one of a ski and a boot;
holes corresponding to said rest pins disposed on the other of said ski and boot;
an outer surface of at least one rest pin forming a friction couple with an inner surface of at least one corresponding hole; and
at least one hole contains a shell of elastic material as an insert therein, the friction couple being formed by the outer surface of the corresponding rest pin and an inner surface of the shell in contact therewith.

3. A ski binding comprising:

rest pins disposed on one of a ski and a boot;

holes corresponding to said rest pins disposed on the other of said ski and boot;

an outer surface of at least one rest pin forming a friction couple with an inner surface of at least one corresponding hole; and the outer surface of at least one pin is furnished with annular grooves.

4. A ski binding comprising:

rest pins disposed on one of a ski and a boot;

holes corresponding to said rest pins disposed on the other of said ski and boot;

at least one hole containing a shell of elastic material, an outer surface of at least one rest pin forming a friction couple with an inner surface of at least one corresponding shell in contact therewith; and at least one hole and corresponding shell has means for adjusting the degree of frictional engagement between a pin and the corresponding shell.

* * * * *